US008411019B2

(12) United States Patent
Agarwal et al.

(10) Patent No.: US 8,411,019 B2
(45) Date of Patent: Apr. 2, 2013

(54) DISPLAY APPARATUS AND CONTROL METHOD THEREOF

(75) Inventors: Pankaj Agarwal, Suwon-si (KR); Kyoung-geun Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1251 days.

(21) Appl. No.: 12/201,669

(22) Filed: Aug. 29, 2008

(65) Prior Publication Data

US 2009/0128544 A1 May 21, 2009

(30) Foreign Application Priority Data

Nov. 21, 2007 (KR) ..... 10-2007-0119417

(51) Int. Cl.
*G09G 3/36* (2006.01)

(52) U.S. Cl. ..... 345/102; 349/61; 362/97.1

(58) Field of Classification Search ..... 345/102; 349/61–71; 362/97.1–97.4
See application file for complete search history.

(56) References Cited

U.S. PATENT DOCUMENTS

2003/0169247 A1 9/2003 Kawabe et al.
2006/0279516 A1* 12/2006 Yun ..... 345/102
2009/0021468 A1* 1/2009 Pankaj et al. ..... 345/102

FOREIGN PATENT DOCUMENTS

EP 1 213 699 A2 6/2002
EP 1 617 712 A1 1/2006

OTHER PUBLICATIONS

European Search Report dated Feb. 6, 2009 issued in counterpart EP application No. 08167174.5.

* cited by examiner

*Primary Examiner* — Michael Pervan
(74) *Attorney, Agent, or Firm* — Sughrue Mion, PLLC

(57) ABSTRACT

A display apparatus includes a display panel, a light source unit including a plurality of light sources that irradiate the display panel with light, a first control signal generating unit that inverts and forward rectifies a scan signal for scanning of the light source unit, a second control signal generating unit that inverts and backward rectifies an overdrive signal for overcurrent emission of the light source unit and has its output port coupled to an output port of the first control signal generating unit, and an inverter that supplies current to the light source unit based on a control signal output from the output port of the first control signal generating unit and the output port of the second control signal generating unit.

10 Claims, 4 Drawing Sheets

DISPLAY APPARATUS AND CONTROL METHOD THEREOF

CROSS-REFERENCE TO RELATED APPLICATIONS

This application claims priority from Korean Patent Application No. 10-2007-0119417, filed on Nov. 21, 2007 in the Korean Intellectual Property Office, the disclosure of which is incorporated herein by reference in its entirety.

BACKGROUND OF INVENTION

1. Field of Invention

Apparatuses and methods consistent with the present invention relate to a display apparatus and a control method thereof, and more particularly, to a display apparatus which is capable of controlling an inverter to cause an overcurrent emission while scanning a light source unit.

2. Description of the Related Art

Display apparatuses such as liquid crystal display (LCD) televisions (TVs) have a problem of a blurring effect that an image edge appears blurred, unclear and hazy due to a slow response speed of liquid crystals in displaying a moving picture. Thereupon, conventional display apparatuses have suppressed such a blurring effect occurring in an image using a scanning method of sequentially driving a plurality of lamps in correspondence to a response speed of liquid crystals.

In the conventional display apparatuses driven by the scanning method, a backlight unit includes a plurality of blocks, each of which includes a plurality of lamps. A scanning signal having a certain frequency (for example, 60 Hz to 120 Hz) is generated to drive the backlight unit so that the plurality of blocks can be sequentially turned on/off.

However, although the conventional display apparatuses driven by the scanning method have suppressed the blurring effect, they have a problem of low average image luminance. Thereupon, the conventional display apparatuses could increase the average image luminance by causing the backlight unit to emit light with more than a reference luminance for scanning for a predetermined period of time.

An inverter supplies current to the backlight unit, and a control signal to control the inverter may be generated by a digital circuit such as a field programmable gate array (FPGA), a microcomputer integrated circuit (IC) or the like. However, the conventional display apparatuses require the digital circuit such as the FPGA, the microcomputer IC or the like to generate the control signal, and the digital circuit has a very complicated structure as well as a high unit price of its parts, which may result in increase of product costs.

SUMMARY OF THE INVENTION

Accordingly, it is an aspect of the present invention to provide a display apparatus which may reduce production costs by implementing an inverter control signal generating circuit with simpler and less expensive parts, and a control method thereof.

Additional aspects of the present invention will be set forth in part in the description which follows and, in part, will be obvious from the description, or may be learned by practice of the present invention.

The foregoing and/or other aspects of the present invention can be achieved by providing a display apparatus comprising: a display panel that displays an image; a light source unit including a plurality of light sources that irradiate the display panel with light; a first control signal generating unit that inverts and forward rectifies a scan signal for scanning of the light source unit; a second control signal generating unit that inverts and backward rectifies an overdrive signal for overcurrent emission of the light source unit and has its output port coupled to an output port of the first control signal generating unit; and an inverter that supplies current to the light source unit based on a control signal output from the output port of the first control signal generating unit and the output port of the second control signal generating unit.

The inverter may include an inverter controller that controls the inverter to supply current to the plurality of light sources based on a preset reference signal, a feedback signal for current flowing through the plurality of light sources, and the control signal.

The inverter controller may include a first operational amplifier having a positive terminal which receives the reference signal and a negative terminal which receives the feedback signal and the control signal.

The first operational amplifier may output control signals having a first voltage level for overcurrent emission of the light source unit, a second voltage level for reference current emission, which is lower than the first voltage level, and a third voltage level for stop of current supply, which is lower than the second voltage level according to the feedback signal and the control signal.

The inverter controller may include a second operational amplifier having a positive terminal which receives an output of the first operational amplifier.

BRIEF DESCRIPTION OF THE DRAWINGS

The above and/or other aspects of the present invention will become apparent and more readily appreciated from the following description of exemplary embodiments, taken in conjunction with the accompanying drawings, in which.

DETAILED DESCRIPTION OF EXEMPLARY EMBODIMENTS OF THE INVENTION

Figure 1:
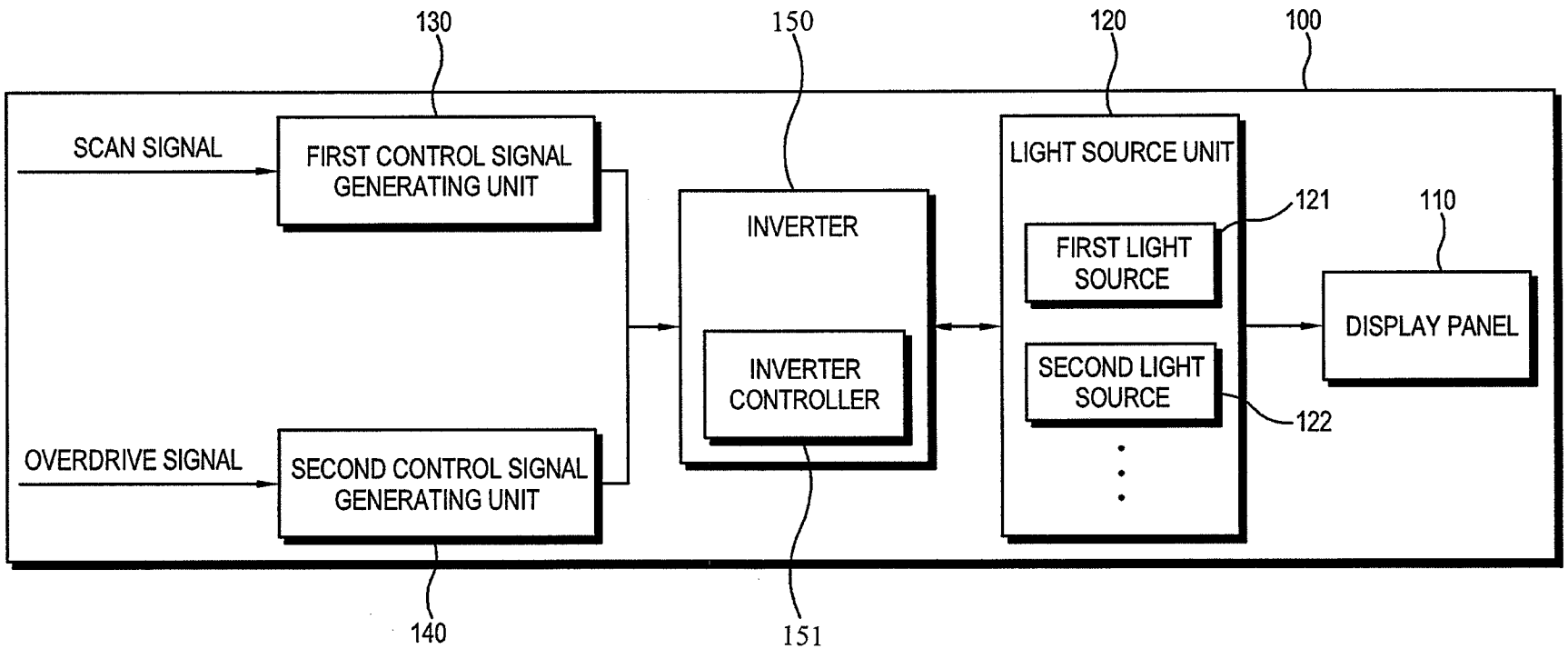
FIG. 1 is a block diagram showing a configuration of a display apparatus according to an exemplary embodiment of the present invention.

Reference will now be made in detail to exemplary embodiments of the present invention, examples of which are illustrated in the accompanying drawings, wherein like reference numerals refer to like elements throughout. The exemplary embodiments are described below so as to explain the present invention by referring to the figures.

FIG. 1 is a block diagram showing a configuration of a display apparatus 100 according to an exemplary embodiment of the present invention. The display apparatus 100 according to the exemplary embodiment of the present invention may generate a scan signal for scanning of a light source unit and an overdrive signal for overcurrent emission of the light source unit. The display apparatus 100 controls an inverter to cause an overcurrent emission while scanning the light source unit, i.e., a backlight unit, based on the scan signal and the overdrive signal. For example, the display apparatus 100 may be implemented by an LCD TV, a monitor or the like.

As shown in FIG. 1, the display apparatus 100 may include a display panel 110, a light source unit 120, a first control signal generating unit 130, a second control signal generating unit 140 and an inverter 150.

The display panel 110 displays an image. The display panel 110 may be implemented by an LCD panel.

The light source unit 120 includes a plurality of light sources 121 and 122 that irradiate the display panel with light. Unlike a plasma display panel (PDP) or a field emission display (FED), a display apparatus using a liquid crystal panel is not self-luminous and serves only to control the transmission amount of light through liquid crystals, and thus requires a light source that supplies uniform light throughout a screen.

The light source unit 120, i.e., the backlight unit, may include a plurality of blocks, each of which is defined by a plurality of lamps which are located in parallel at a rear side of the liquid crystal panel. The lamps used for the light sources may be implemented by cathode fluorescent lamps that emit white light, such as cold cathode fluorescent lamps (CCFLs), hot cathode fluorescent lamps (HCFLs) or the like.

Figure 2:
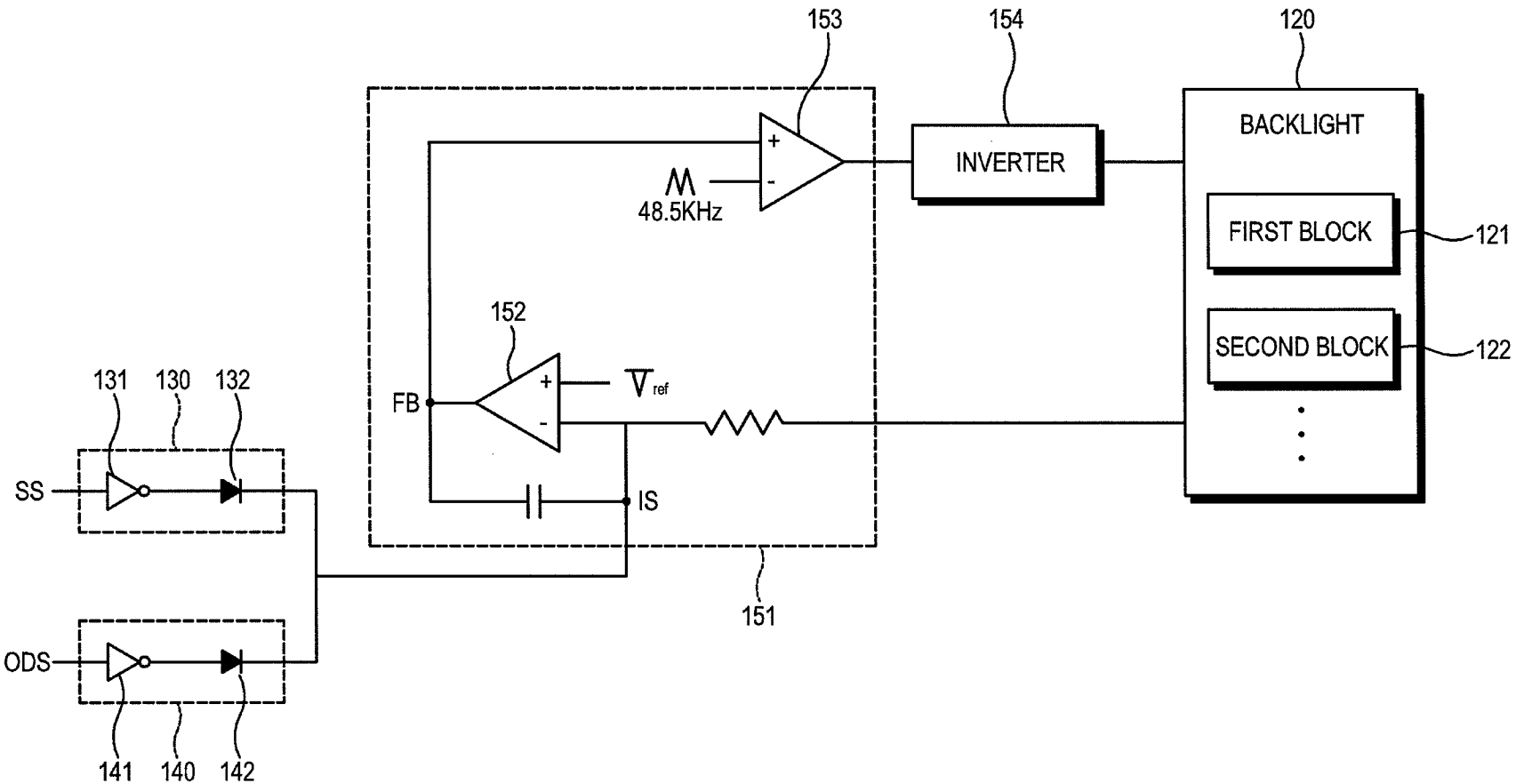
FIG. 2 is a circuit diagram showing a detailed configuration of the display apparatus according to an exemplary embodiment of the present invention.

The first control signal generating unit 130 inverts and forward rectifies the scan signal for scanning of the light source unit 120. As shown in FIG. 2, the first control signal generating unit 130 may include a NOT gate 131 and a forward diode 132. The scan signal SS input to the first control signal generating unit 130 is inverted by the NOT gate 131 and is rectified by the forward diode 132. The scan signal SS is used for scanning of the light source unit 120 and its waveform is as shown in FIG. 3.

For example, the first control signal generating unit 130 outputs a LOW level signal of 0 V with an input of a HIGH level signal of 3.3 V and outputs a HIGH level signal of 3.3 V with an input of a LOW level signal of 0 V.

The second control signal generating unit 140 inverts and backward rectifies the overdrive signal for overcurrent emission of the light source unit 120 and has its output port coupled to an output port of the first control signal generating unit 130. As shown in FIG. 2, the second control signal generating unit 140 may include a NOT gate 141 and a backward diode 142. The overdrive signal ODS input to the second control signal generating unit 140 is inverted by the NOT gate 141 and is rectified by the backward diode 142.

Figure 3:
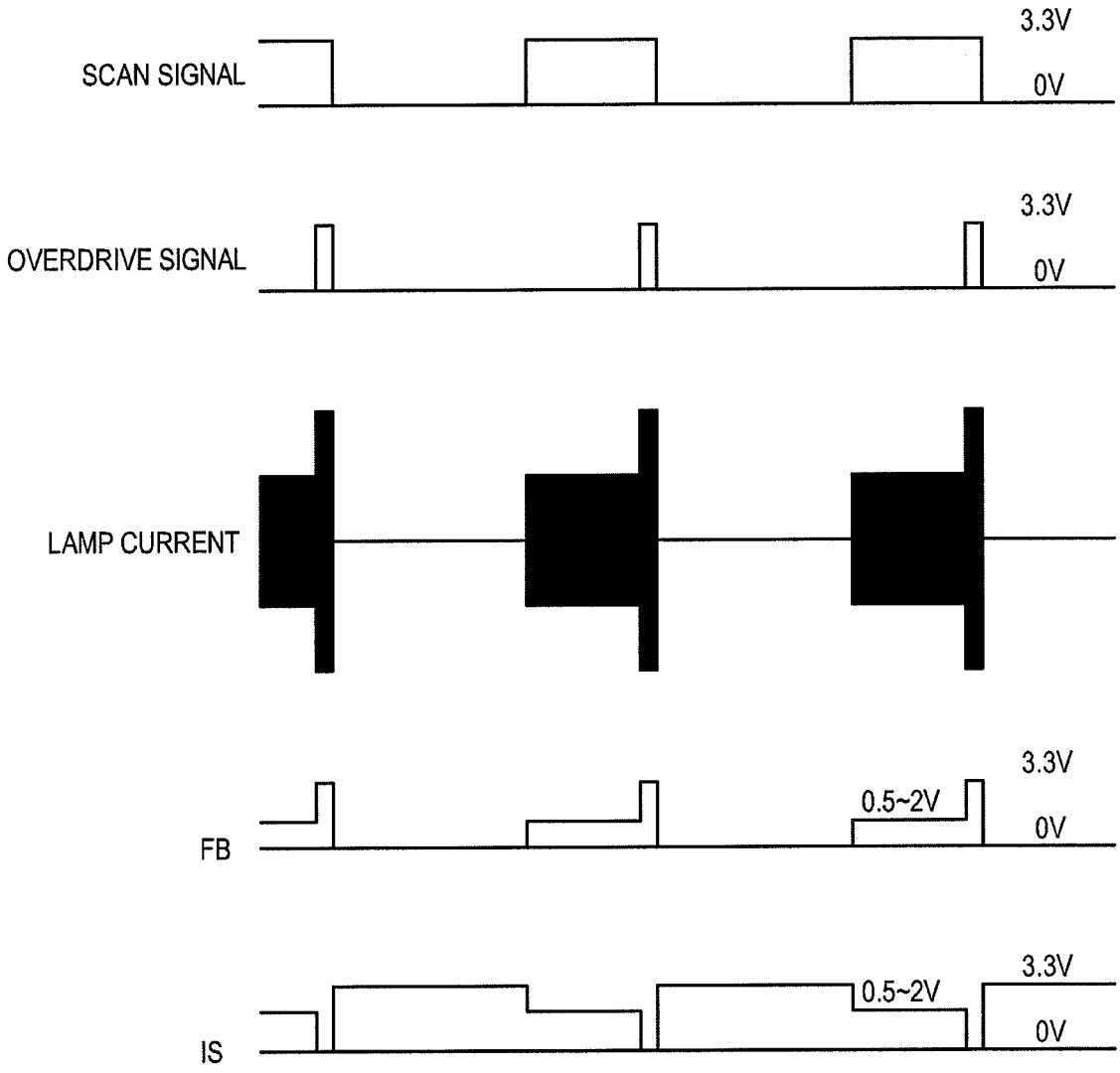
FIG. 3 is a timing diagram showing waveforms of a scan signal, an overdrive signal, a lamp current signal and two control signals in an inverter controller.

The overdrive signal is used for overcurrent emission of the light source unit 120 and its waveform is as shown in FIG. 3. The overdrive signal ODS is generated within an interval during which the scan signal SS is in an ON state, and overcurrent is supplied to a lamp in an interval during which the overdrive signal ODS overlaps with the scan signal SS such that the lamp emits light with more than reference luminance for scanning. For example, the second control signal generating unit 140 outputs a low level signal with an input of a HIGH or LOW level signal.

In addition, since the output port of the second control signal generating unit 140 is coupled in parallel to the output port of the first control signal generating unit 130, a signal having a higher voltage of a first control signal and a second control signal is output, as a final control signal IS, to an inverter controller 151. A level of voltage of the control signal IS according to the input of the scan signal SS and the overdrive signal ODS may be obtained from the following equation (1).

$$3.3[(SS \text{ OR } ODS)']+(0.5\sim2)[(SS \text{ AND } ODS')]=IS \quad (1)$$

The inverter 150 supplies current to the light source unit 120 based on the control signals output from the output port of the first control signal generating unit 130 and the output port of the second control signal generating unit 140. The inverter 150 may also include the inverter controller 151 that controls the inverter to supply current to the plurality of light sources based on a preset reference signal, a feedback signal for current flowing through the plurality of light sources, and a control signal. Here, the feedback signal has a level of voltage corresponding to the current supplied to the light source unit 120.

As shown in FIG. 2, the inverter controller 151 may include a first operational amplifier 152 having a positive terminal which receives the reference signal Vref and a negative terminal which receives the feedback signal and the control signal IS, and a second operational amplifier 153 having a positive terminal which receives an output FB of the first operational amplifier 152. In this case, the control signal IS output from the output port of the first control signal generating unit 130 and the output port of the second control signal generating unit 140 is coupled in parallel to a line through which the feedback signal is input to the first operational amplifier 152.

The first operational amplifier 152 may output control signals having a first voltage level for overcurrent emission of the light source unit 120, a second voltage level for reference current emission, which is lower than the first voltage level, and a third voltage level for stopping current supply, which is lower than the second voltage level according to the feedback signal and the control signal IS. As shown in FIG. 3, the output signal FB of the first operational amplifier 152 may have the first voltage level of 3.3 V, the second voltage level of 0.5 V to 2 V, and the third voltage level of 0 V.

The output signal FB of the first operational amplifier 152 is input to the positive terminal of the second operational amplifier 153 and a second reference signal having a frequency of 48.5 kHz is input to a negative terminal of the second operational amplifier 153. The second operational amplifier 153 adjusts a duty cycle of an inverter 154 according to the output signal FB of the first operational amplifier 152 and a driving signal so as to supply current to the light source unit 120.

From the timing diagram of the above signals, which is shown in FIG. 3, it can be seen that the control signal IS is determined according to the scan signal SS and the overdrive signal ODS, the output signal FB of the first operational amplifier 152 is determined according to the control signal IS, and the amount of current supplied to a lamp is determined in proportion to the magnitude of the output signal FB of the first operational amplifier 152.

The following Table 1 shows a voltage level of the control signal IS and a voltage level of the output signal FB of the first operational amplifier 152 according to the scan signal SS and the overdrive signal ODS.

TABLE 1

| Scan signal SS | Overdrive signal ODS | Control signal IS | Output signal FB |
|---|---|---|---|
| LOW | LOW | HIGH | LOW |
| HIGH | LOW | 0.5 V to 2 V | 0.5 V to 2 V |
| LOW | HIGH | X | X |
| HIGH | HIGH | LOW | HIGH |

As can be seen from the above Table 1, when the scan signal SS has a HIGH voltage level and the overdrive signal ODS has a LOW voltage level, the voltage levels of the control signal IS and the output signal FB of the first operational amplifier 152 are determined to have a voltage value of 0.5 V to 2 V according to the feedback signal.

Figure 4:
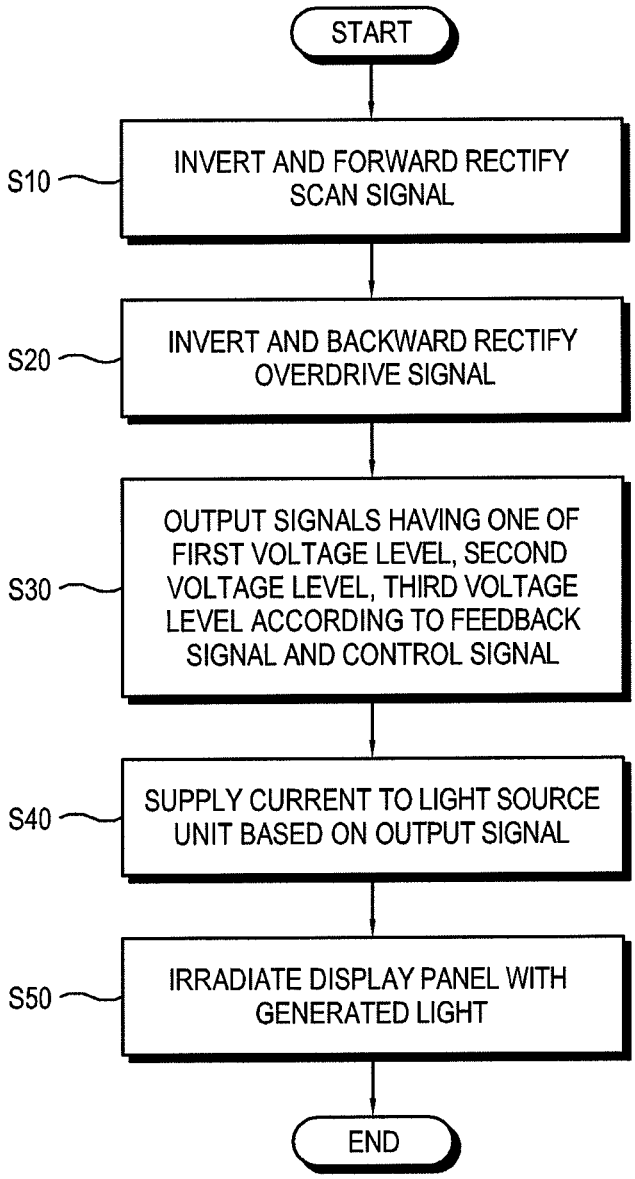
FIG. 4 is a flowchart showing a control method of the display apparatus according to an exemplary embodiment of the present invention.

FIG. 4 is a flowchart showing a control method of the display apparatus according to an exemplary embodiment of the present invention.

First, the first control signal generating unit 130 inverts and forward rectifies the scan signal for scanning of the light source unit 120, to generate the first control signal (S10).

The second control signal generating unit 130 inverts and backward rectifies the overdrive signal for overcurrent emission of the light source unit 120 to generate the second control signal (S20). The first control signal and the second control signal are input to the first operational amplifier 152 as the control signal IS.

The first operational amplifier 152 outputs the output signals FB having one of the first voltage level for overcurrent emission of the light source unit 120, the second voltage level for reference current emission, which is lower than the first voltage level, and the third voltage level for stopping current supply, which is lower than the second voltage level according to the feedback signal and the control signal IS (S30).

The second operational amplifier 153 adjusts a duty cycle of an inverter 154 according to the output signal FB so as to supply current to the light source unit 120. After then, current is supplied to the light source unit 120 (S40) and the generated light is irradiated to the display panel 110 (S50).

As described above, exemplary embodiments of the present invention provide a display apparatus which is capable of reducing production costs by implementing an inverter control signal generating circuit with more simple and more inexpensive parts, and a control method thereof.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A display apparatus comprising:

a display panel;

a light source unit comprising a plurality of light sources that irradiate the display panel with light;

a first control signal generating unit that inverts and forward rectifies a scan signal for scanning of the light source unit;

a second control signal generating unit that inverts and backward rectifies an overdrive signal for overcurrent emission of the light source unit and has an output port coupled to an output port of the first control signal generating unit; and an inverter that supplies current to the light source unit based on a control signal output from the output port of the first control signal generating unit and the output port of the second control signal generating unit.

2. The display apparatus according to claim 1, wherein the inverter comprises an inverter controller that controls the inverter to supply current to the plurality of light sources based on a reference signal, a feedback signal for current flowing through the plurality of light sources, and the control signal.

3. The display apparatus according to claim 2, wherein the inverter controller comprises a first operational amplifier having a positive terminal which receives the reference signal and a negative terminal which receives the feedback signal and the control signal.

4. The display apparatus according to claim 3, wherein the first operational amplifier outputs signals having a first voltage level for overcurrent emission of the light source unit, a second voltage level for reference current emission, which is lower than the first voltage level, and a third voltage level for stopping current supply, which is lower than the second voltage level, according to the feedback signal and the control signal.

5. The display apparatus according to claim 2, wherein the inverter controller comprises a second operational amplifier having a positive terminal which receives an output of a first operational amplifier.

6. A method of controlling a display, the method comprising:

inverting and forward rectifying a scan signal for scanning of a light source unit, to generate a first control signal;

inverting and backward rectifying an overdrive signal for overcurrent emission of the light source unit, to generate a second control signal;

supplying current to the light source unit based on the first control signal and the second control signal, to generate light; and irradiating a display panel with the generated light.

7. The method of claim 6, wherein the current is supplied to the light source unit based on a reference signal, a feedback signal for current flowing through a plurality of light sources of the light source unit, and the first and second control signals.

8. The method of claim 7, wherein the display comprises a first operational amplifier having a positive terminal which receives the reference signal and a negative terminal which receives the feedback signal and the first and second control signals.

9. The method of claim 8, wherein the first operational amplifier outputs signals having a first voltage level for over current emission of the light source unit, a second voltage level for reference current emission, which is lower than the first voltage level, and a third voltage level for stopping current supply, which is lower than the second voltage level, according to the feedback signal and the first and second control signals.

10. The method of claim 8, wherein the display comprises a second operational amplifier having a positive terminal which receives an output of the first operational amplifier.

* * * * *